US006345777B1

(12) United States Patent
Leaver

(10) Patent No.: US 6,345,777 B1
(45) Date of Patent: Feb. 12, 2002

(54) METHODS AND APPARATUS FOR THE INTRODUCTION OF FIBROUS MATERIAL INTO A SUBSTANCE

(75) Inventor: Roger Leaver, Monmouthshire (GB)

(73) Assignee: Excel Industries Ltd., Gwent (GB)

( * ) Notice: Subject to any disclaimer, the term of this patent is extended or adjusted under 35 U.S.C. 154(b) by 0 days.

(21) Appl. No.: 09/487,243

(22) Filed: Jan. 20, 2000

(51) Int. Cl.[7] ..... B02C 19/12
(52) U.S. Cl. ..... 241/21; 241/25; 241/101.8
(58) Field of Search ..... 241/26, 5, 30, 241/1, 21, 101.8, 101.2, 25

(56) References Cited

U.S. PATENT DOCUMENTS 4,022,439 A 5/1977 Groth
4,092,737 A 5/1978 Sandell
4,121,943 A 10/1978 Akazawa et al.
4,765,547 A 8/1988 Marui et al.

FOREIGN PATENT DOCUMENTS

DE 4336403 A1 4/1995
WO WO 86/00044 1/1986

*Primary Examiner*—Mark Rosenbaum
(74) *Attorney, Agent, or Firm*—Young & Thompson

(57) ABSTRACT

Fibers to be introduced into a mixture are initially pelletized or granulated at a compacting station. The pellets or granules are then transported to a user station where they are stored, and then re-fiberized as required ready for use and introduced into a mixer where they are mixed with other ingredients to provide a mixture with the required properties which is then ready for delivery.

16 Claims, 1 Drawing Sheet

METHODS AND APPARATUS FOR THE INTRODUCTION OF FIBROUS MATERIAL INTO A SUBSTANCE

BACKGROUND OF THE INVENTION

This invention relates to methods and apparatus for the introduction of fibrous material into a substance or mixture. In particular but not exclusively, the invention relates to such methods in which cellulose fibres, other organic fibres or mineral fibres are provided in pelletised form for subsequent addition to mixture of ingredients.

DESCRIPTION OF THE RELATED ART

Cellulose or mineral fibre are commnonly used to modify the rheological properties of liquid systems, including those based on cement and water, and those based on bitumen. The fibres have a gelling or thickening effect on these systems which may include, for example, a cement-based tile adhesive or a bituminous road surfacing compound. Cellulose and mineral fibre usage has increased partly due to the demise of asbestos fibre.

Cellulose fibre may be derived for example from recycled paper, timber, woodpulp, or various other agri-materials such as straw, flax. Other organic fibres include, for example, polyester, polythene and polypropylene. Mineral fibre is commonly made from glass, basaltic rock or steel slag.

Fibre is normally supplied in compressed bales which may be from 1 Kg to 400 Kg in weight. There are three main methods for adding fibre to the mixes. In one such method, bales may be added direct to a mixer. Thus, in the case of hot bitumen mixes, the whole bale (including polyethylene packaging) may be added, the plastic quickly dissolving into the hot liquid bitumen. Alternatively, and particularly in the use of dry powder mixes, the fibre is emptied from the packaging direct into the mixer, or perhaps via a hopper and screw arrangement, possibly after a weighing operation to obtain the exact quantity required for a batch. These methods are labour intensive and often require an operative to work very close to mixing machinery, with environmental problems of dust, fumes and noise.

In a further method, bales of fibre may be emptied into a pneumatic blowing machine and dosed gravimetrically or volumetrically into the mixer along a pipe which may be 25–150 mm in diameter for example. This method lends itself to the use of bigger bales with consequent reductions in labour intensity, and also provides a solution to the environmental problems. However, it still falls short of true bulk handling.

In another method, the fibre may be pelletised, or granulated possibly by the fibre manufacturer, in a pelletising or granulating process in which small compressed pellets or granules are formed by extrusion, pressing or other available method. Normally, an additive is used which lubricates this process and acts as a binder. This additive may be bitumen, wax, oil or other suitable materials. However it is also possible to pelletise or granulate some fibres without any additives. The pellets or granules lend themselves to true bulk handling. They can be delivered in bulk loads of up to 20 tonnes and blown into a silo in a similar method to that used for animal feed pellets for example. From the silo, pellets or granules can be screwed, conveyed, dosed or weighed as required in a fully automatic manner without labour costs. However, the use of pellets or granules is very often not preferred because it is difficult to achieve an effective dispersion of the fibre due to the work required in the mixer to break up the hard-compressed pellets or granules into their constituent fibres.

Where pellets or granules are used, as a component of powder or liquid mixes, the mixer is relied upon to achieve a fortuitous breakdown of the pellets or granules into dispersed fibre by shear, attrition and abrasion effected by the other components of the mix which may include stone aggregate for example, the mixer paddles themselves and possibly by the elevated temperature of the mixture causing the binder material if present to soften, or to diminish the binding effect. Dispersion of fibre in this way is not what the mixer was designed to achieve and, therefore, it performs the task usually inefficiently. The result can be longer mixing times with consequent reduction in plant capacity and increased wear and tear and power consumption. Even then, dispersion may be incomplete resulting in non-homogeneous mixes and inconsistent thickening effect.

SUMMARY OF THE INVENTION

We have therefore designed an improved method for the addition and substantially uniform dispersion of fibres in a mixture which overcomes or mitigates at least some of the disadvantages of the above methods. In particular it provides a method in which the fibrous material is initially rendered into compact pelletised or granulated form for efficient storage, handling and transport and then returned to an open fluffy state at the mixing station. This considerably improves storage, transport and handling of the fibre as it is in a compact form which can be transported and handled in bulk and which also can be metered automatically into a mixture using a screw conveyor and the like.

The process also includes the novel step of refibreising the pellets or granules prior to addition to the mixture. Thus the method as a whole includes the innovative feature of temporarily reducing a fibrous material to a compact pelletised or granular state for storage, transport, handling and metering and thereafter returning it to an open-textured state prior to mixing.

In one aspect, this invention provides a method of producing a substantially uniform dispersion of fibrous material in a mixture, which comprises:

providing a supply of pellets or granules of compacted fibrous material;

refibreising said pellets or granules to cause at least some of said pellets or granules to expand to a relatively open-textured fibrous material; and introducing said refibreised fibrous material into said mixture and mixing it therewith.

In another aspect, this invention provides a method of producing a substantially uniform dispersion of fibrous material in a mixture at a mixing station which comprises:

pelletising or granulating at a pelletising or granulating station a fibrous base material by at least one of compaction and possibly binding of the fibres of the fibrous base material;

transporting said pelletised or granular base material to a remote refibreising station;

refibreising said pelletised or granular base material to recover a relatively open-textured fibrous material; and introducing and mixing said refibreised fibrous material into said mixture.

In each aspect, said fibrous material preferably comprises cellulose or other organic or mineral fibres or a mixture thereof. Cellulose fibre may be derived from e.g. recycled paper, timber, woodpulp or various other agri-materials such as flax or straw. Organic fibres may be of polyethylene, polyester, or polypropylene. Mineral fibres may be derived from glass, basaltic rock or steel slag.

Preferably, said refibreising is performed by means of one or more of grinding hammer-milling, disc-refining, pulverising and air impaction or other means of attrition. The preferred objective is to separate the fibres by mechanical means without causing unnecessary damage to the fibres themselves. The opening and re-fibreising of the material may continue after addition to the mixture, by the mixing action applied thereto.

Said mixture may comprise a wide range of different materials, but this method has been designed with particular reference to the addition of fibrous material into a liquid-based system to improve its rheological properties, for example those based on cement and water (e.g. a cement-based tile adhesive) and those based on bitumen (e.g. road-surfacing compounds).

In another aspect, there is provided apparatus for the introduction of a generally open-textured fibrous material into a mixture, said apparatus comprising:storage means adapted to store in use a supply of pelletised or granulated fibrous material;

a fibreising means adapted to expand said pelletised or granular material to a generally open-textured form;

means for delivering in use said pelletised or granular fibrous material from said storage means to said fibreising means;

means for conveying said expanded open-textured fibrous material from said fibreising means, and introducing it into said mixture.

In yet a further aspect, this invention provides a method for the transport and metering of a fibrous additive material into a mixture, which method comprises reducing said fibrous additive material from an open-textured form into compact pelletised or granular form, transporting said pelletised or granular fibrous additive material to a mixing station, returning said fibrous material from said compact pelletised or granular form to an open-textured form, and thereafter adding said open-textured material to said mixture.

Whilst the invention has been described above, it extends to any inventive combination of features set out above or in the following description.

BRIEF DESCRIPTION OF THE DRAWING

The invention may be performed in various ways, and an embodiment thereof will now be described by way of example only, reference being made to the accompanying drawing, in which.

DESCRIPTION OF THE PREFERRED EMBODIMENT

Figure 1:
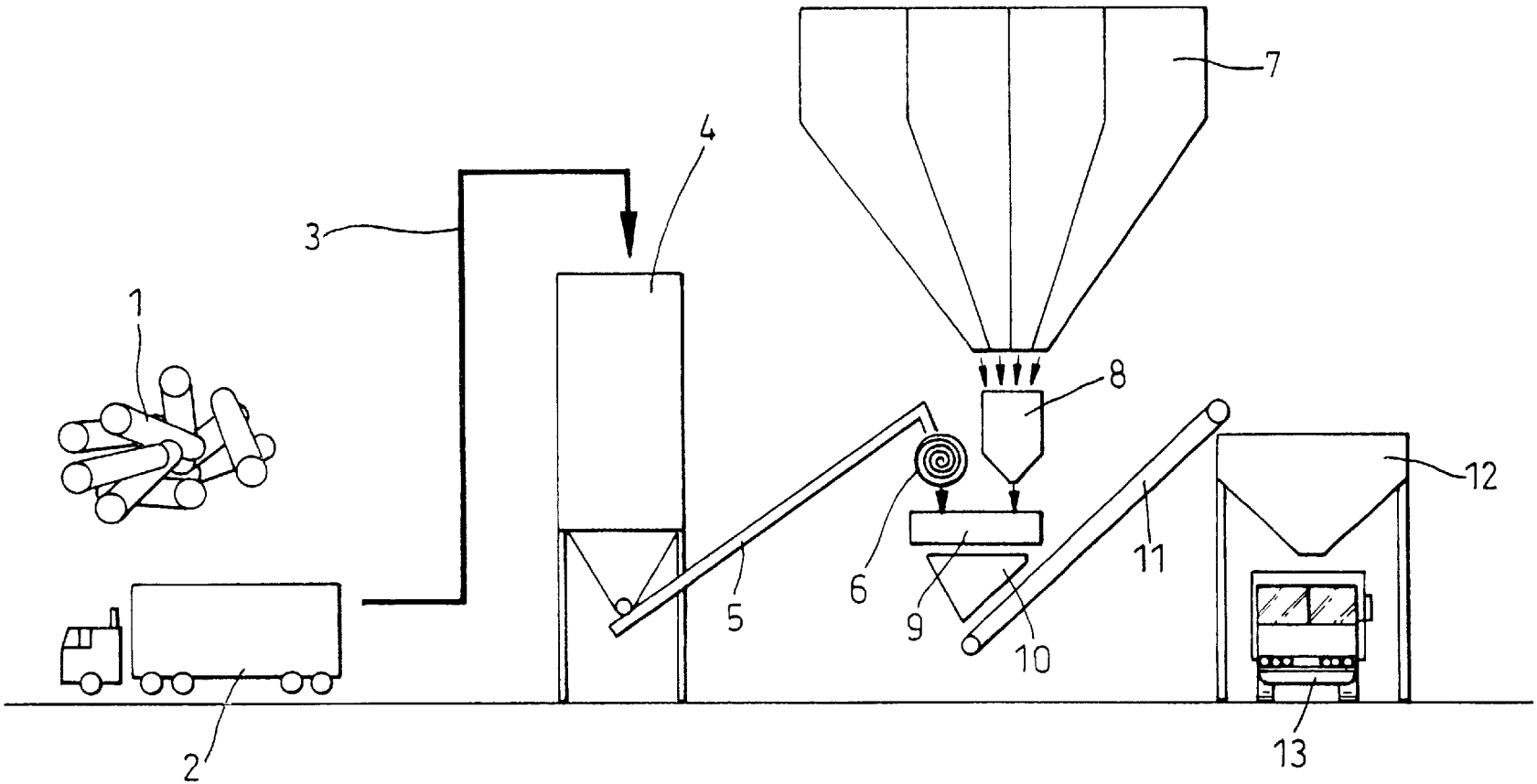
FIG. 1 is a schematic view of a refibreising and mixing station for use in an embodiment of the invention.

The described embodiment implements a storage handling and metering system for fibrous materials. In this system fibrous material is initially rendered into compact pelletised or granulated form using generally conventional techniques, so that the material may be handled and transported relatively easily. Thereafter the pellets or granules are passed to a fibreising means which breaks down the pellets or granules so as to regenerate the open, 'fluffy' fibrous matrix from which the pellets or granules were made. This fibrous matrix can then be passed to a mixer where it is readily dispersed in either the liquid or powder mixture without the need for excessive mixing.

The fibreiser consists of a system for inputting the pellets or granules, a method of 'opening' them to reconstitute the raw fibre, and an output system to discharge the fibre. The method used to open the fibre can employ one of many available techniques including grinding, hammer-milling, disc refining, pulverising and air impaction. Different types of pellet or granules may be best handled by different of these various techniques and each application would need to be considered on its merits. The throughput of the fibreiser can be controlled by air conveying, gravity, centrifugal forces or by a combination of methods. The fibreiser is placed at a convenient point in the line between the storage hopper or silo for the pellets or granules, and the mixer to which they are to be added. Feed to the fibreiser can be by gravity, screw or belt conveyor or by pneumatic blowing for example, and the discharge into the mixer can equally employ one or more of these methods.

Referring now to the Figure, this shows a schematic arrangement for a typical process for making a mixture including dispersed fibre in accordance with this invention. The process shown is that which might be used for the production of road asphalt although the invention could equally be applied to other mixtures which include a liquid component or to dry powder mixes.

Fibre pellets or granules 1 previously produced by extrusion, pressing etc. with or without a binder as required are delivered by a bulk vehicle 2 and blown pneumatically via a pipe 3 into a storage silo 4. A screw conveyor 5 conveys the pellets as required. The pellets then fall by gravity through a fibreiser 6 into a mixer 9.

The fibreiser may employ one or more of the actions described above, thereby partially or fully opening the fibre pellets or granules to at least partially return them to an open matrix form whereby substantially uniform distribution of the constituent fibres throughout the mixture is assured. At the same time, different grade aggregates which are stored in the hoppers 7 are weighed into the weigh hopper 8 which also discharges into the mixer 9. Hot liquid bitumen is added and, on completion of mixing, the batch is dropped into a discharge chute 10, and travels along a conveyor 11 into a storage hopper 12, where it is held until it is required to be loaded into a lorry 13 for transport to the road construction site.

What is claimed is:

1. A method of producing a substantially uniform dispersion of fibrous material in a substance, which comprises:

obtaining a supply of pellets or granules of compacted fibrous material at a first location transporting said compacted fibrous material to a second, remote location;

at the second location, refibreising said pellets or granules to cause at least some of said pellets or granules to expand to a relatively open-textured fibrous material; and introducing said refibreised fibrous material into said substance and mixing it therewith.

2. A method according to claim 1, wherein said fibrous material comprises cellulose, other organic fibre, or mineral fibres or a mixture thereof.

3. A method according to claim 1, wherein said refibreising is performed by means of one or more of grinding, hammer-milling, disc-refining, pulverising and air impaction.

4. A method according to claim 1, wherein said substance is liquid-based.

5. A method according to claim 1, wherein said substance comprises a mixture of cement and water.

6. A method of producing a substantially uniform dispersion of fibrous material in a substance at a mixing station which comprises:

pelletising or granulating at a pelletising or granulating station a fibrous base material by at least compaction of the fibres of the fibrous base material;

transporting said pelletised or granular base material to a remote refibreising station;

refibreising said pelletised or granular base material to recover a relatively open-textured fibrous material; and introducing and mixing said refibreised fibrous material into said substance.

7. A method according to claim 6, wherein said pelletising or granulating step includes binding of the fibres of the fibrous material.

8. A method according to claim 6, wherein said fibrous material comprises cellulose, other organic fibre, or mineral fibres or a mixture thereof.

9. A method according to claim 8, wherein said cellulose fibres are derived from one or more of recycled paper, timber, wood pulp, flax or straw.

10. A method according to claim 8, wherein said mineral fibres are derived from one or more of glass, basaltic rock or steel slag.

11. A method according to claim 6, wherein said refibreising is performed by means of one or more of grinding, hammer-milling, disc-refining, pulverising and air impaction.

12. A method according to claim 6, wherein said substance is liquid-based.

13. A method according to claim 6, wherein said substance comprises a mixture of cement and water.

14. A method according to claim 12, wherein said substance comprises bitumen-based material.

15. A method for the transport and metering of a fibrous additive material into a substance, which method comprises obtaining said fibrous additive material having been taken from an open-textured form into a compact pelletised or granular form, transporting said pelletised or granular fibrous additive material to a mixing station, returning said fibrous material from said compact pelletised or granular form to an open-textured form, and thereafter adding said open-textured material to said substance.

16. A method of producing road asphalt which comprises the steps of:

pelletising or granulating at a pelletising or granulating station a fibrous cellulose-based material by at least compaction of the fibres to form pelletised or granular cellulose fibre material;

transporting said pelletised or granular cellulose fibre material to a remote refibreising station;

refibreising said pelletised or granular cellulose fibre material to recover a relatively-open textured cellulose fibre material;

introducing said relatively-open textured cellulose fibre material into a mixer into which hot liquid bitumen is added in association with aggregate material, and mixing said re-fibreised cellular fibre material with said bitumen and aggregate material to form said road asphalt material.

* * * * *